US008807096B2

(12) United States Patent
Traudt

(10) Patent No.: US 8,807,096 B2
(45) Date of Patent: Aug. 19, 2014

(54) HEAT MANAGEMENT MODULE OF THE COOLING SYSTEM OF AN INTERNAL COMBUSTION ENGINE

(75) Inventor: Thomas Traudt, Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 575 days.

(21) Appl. No.: 13/056,910

(22) PCT Filed: Jul. 3, 2009

(86) PCT No.: PCT/EP2009/058433

§ 371 (c)(1),
(2), (4) Date: Mar. 15, 2011

(87) PCT Pub. No.: WO2010/012563

PCT Pub. Date: Feb. 4, 2010

(65) Prior Publication Data

US 2011/0162595 A1 Jul. 7, 2011

(30) Foreign Application Priority Data

Jul. 31, 2008 (DE) ..... 10 2008 035 961

(51) Int. Cl.
*F01P 7/14* (2006.01)

(52) U.S. Cl.
USPC ..... 123/41.1; 251/59; 137/625.41

(58) Field of Classification Search
USPC ..... 123/41.1; 251/59; 137/625.41
See application file for complete search history.

(56) References Cited

U.S. PATENT DOCUMENTS 4,335,867 A * 6/1982 Bihlmaier ..... 251/28
4,510,893 A * 4/1985 Schweiger et al. ..... 123/41.02

(Continued)

FOREIGN PATENT DOCUMENTS

DE 224085 A1 6/1985
DE 34 35 833 A1 4/1986

(Continued)

OTHER PUBLICATIONS

Findeisen, Dietmar: Oelhydraulik. Springer-Verlag,1994, 4 Aufl. ISBN 3-540-54465-8 S.199, Bild 3-22.

*Primary Examiner* — Marguerite McMahon
*Assistant Examiner* — James Kim
(74) *Attorney, Agent, or Firm* — Davidson, Davidson & Kappel, LLC

(57) ABSTRACT

A heat management module of a cooling system of an internal combustion engine which has a valve housing that includes at least one first feed connection for cooling water of a bypass circuit and at least one adjacent second feed connection for cooling water of a radiator circuit. The feed connections can be connected to a discharge connection depending on the position of a valve member accommodated in the valve housing. A driving element which actuates the valve member is provided on the valve housing. The driving element is a hydrostatic servo motor, which produces a rotating driving motion and which uses a feed pressure line that branches from the cooling system for pressurization.

8 Claims, 1 Drawing Sheet

(56) References Cited

U.S. PATENT DOCUMENTS

| | | | | |
|---|---|---|---|---|
| 4,598,736 | A * | 7/1986 | Chorkey | 137/625.65 |
| 4,644,909 | A * | 2/1987 | Nishikata et al. | 123/41.1 |
| 4,744,335 | A * | 5/1988 | Miller | 123/41.1 |
| 4,902,945 | A * | 2/1990 | Meades et al. | 318/467 |
| 4,961,404 | A | 10/1990 | Itakura et al. | |
| 5,529,026 | A | 6/1996 | Kurr et al. | |
| 6,539,899 | B1 | 4/2003 | Piccirilli et al. | |
| 6,920,845 | B2 * | 7/2005 | Lelkes et al. | 123/41.01 |
| 6,976,505 | B2 * | 12/2005 | McLane et al. | 137/625.11 |
| 2005/0034688 | A1 | 2/2005 | Lelkes et al. | |

FOREIGN PATENT DOCUMENTS

| | | | |
|---|---|---|---|
| DE | 40 33 261 | A1 | 4/1992 |
| DE | 197 17 295 | A1 | 10/1998 |
| DE | 198 49 492 | A1 | 5/2000 |
| DE | 10 2006 053 310 | A1 | 5/2008 |
| WO | 03/042517 | A | 5/2003 |

* cited by examiner

HEAT MANAGEMENT MODULE OF THE COOLING SYSTEM OF AN INTERNAL COMBUSTION ENGINE

FIELD OF THE INVENTION

The present invention relates to a heat management module of the cooling system of an internal combustion engine, which has at least one first feed connection arranged in a valve housing for coolant of a bypass circuit and at least one adjacent second feed connection for coolant of a radiator circuit. The connections, which depend on the position of a valve member accommodated in the valve housing, are connectable to a discharge connection. Driving means for actuating the valve member are provided on the valve housing. Furthermore, the invention also relates to a cooling system which comprises such a heat management module.

BACKGROUND OF THE INVENTION

The cooling system of an internal combustion engine generally comprises two coolant circuits. A bypass circuit, also referred to as a short circuit, returns the coolant to the internal combustion engine without cooling. In the radiator circuit the coolant first flows through a heat exchanger referred to as a radiator before being returned to the internal combustion engine. In the heat exchanger excess heat is dissipated and given off to a secondary coolant. The two cooling circuits of the internal combustion engine may be activated simultaneously or with a time lag. By specifically distributing the coolant flow to both circuits the internal combustion engine is adjusted in the optimum coolant temperature range. This primarily serves to ensure that the admissible temperature limits for the engine and the transmission are adhered to. In addition, account also has to be taken of the competing demands for an optimum warm-up with minimal fuel consumption and a rapid interior climate control. In modern state-of-the-art cooling systems this is usually implemented through flexibly activated components, such as an electrical coolant pump, the speed of which is not fixedly coupled to the speed of the crankshaft, and an electrically activated map-controlled thermostat, electrical fan and heating valves. It is thereby possible to design the cooling system for the aforementioned boundary conditions including a flexible heat management. Intelligent heat management moreover also makes it possible to reduce the fuel consumption and pollutant emissions. An externally cooled exhaust gas recirculation and the shortening of the warm-up phase through coolant stoppage and an isolation of thermal masses are particularly suited to this purpose. These objectives can be achieved by adjusting the coolant temperature to the prevailing load range of the internal combustion engine with the aid of a heat management module.

U.S. Pat. No. 4,644,909 discloses such a heat management module. The heat management module comprises a valve mechanism, which serves to control a radiator circuit and/or a bypass circuit of a cooling system. This is done by means of an electric motor, which can be controlled by an electronic control, which on the input side analyzes the signal from a coolant temperature sensor in order to actuate the valve mechanism as a function of the prevailing coolant temperature, so that the mixing ratio of the coolant between the cooling circuits is adjusted on the basis of a preset coolant temperature. The valve mechanism comprises a valve spool, which performs either a linear or a rotational switching motion. Accordingly, the electric motor drive is embodied either as a linear drive, for example in the form of a proportional magnet, or as an electric stepping motor for generating the rotational switching motion.

DE 198 49 492 A1 discloses a further heat management module, which comprises a valve member for controlling a bypass circuit and a radiator circuit of a cooling system. In this state of the art the valve member is embodied as a rotary spool, which is driven by an electric motor. The electric motor drive serves to bring the valve member selectively into a closed position for the radiator circuit and the bypass circuit, or into an open position between the radiator circuit or the bypass circuit. In addition, it is also possible to produce a mixed operation by simultaneously connecting the radiator circuit and the bypass circuit to the discharge connection, in order to achieve a heat management within the cooling circuit through a map-controlled cooling. By selecting a suitable switching position of the valve mechanism, an optimum coolant temperature is possible for any operating state of the internal combustion engine, which leads to the reduction in fuel consumption and pollutant emissions mentioned in the introduction whilst at the same time protecting the internal combustion engine.

SUMMARY OF THE INVENTION

The electric motor drive of the valve mechanism, however, has a detrimental effect on the state of the art previously discussed, since an electric motor drive in a heat management module, which comprises a coolant flow-carrying valve mechanism, must allow a reliably permanent watertight separation of the coolant flow-carrying and electromechanical component areas. Otherwise, for example, an unwanted coolant overflow via a leaky seal into the area of the electric motor drive could cause an electrical short-circuit there, or progressive wear leading to the failure of the drive for the heat management module. Furthermore, the requirements for electromechanical components in vehicle construction in respect of the prevailing ambient conditions in the area of the cooling system can generally only be satisfied by elaborate designs which are capable of meeting the specific increased temperatures, the sealing characteristics inevitably required, the desired performance requirement and service life.

Thus, attempts have already been made, for example, to accommodate the electric motor drive of a valve mechanism of a heat management module in a separate housing and to transmit the drive to the valve mechanism via a spur gear train. Although the separate housings prevent coolant getting into the electric motor drive via a leaking seal, this spatial separation comes at the technical expense of an additional gear train for transmitting the force and takes up a very large overall space.

The object of the present invention therefore is to create a heat management module of a cooling system for an internal combustion engine, which is of compact construction and robust design and which at the same time can be operated without risk of leakage over the entire service life in the cooling system.

The object is achieved in accordance with the heat management module of the present invention.

The invention includes the technical teaching that the driving means for actuating the valve member of a heat management module are embodied as a hydrostatic servo motor, which produces a rotational driving motion and which for pressurization uses a feed pressure line branching off from the cooling system.

The particular advantage of the solution according to the invention is that use can be made of the high power density and robustness of hydraulic drives compared to electromechanical drives, and secondly that a durably pressure-tight torque transmission to the valve member is ensured, because the required drive torque is produced directly on the valve member. The solution according to the invention functions without any external leakage and makes use of the hydraulic pressure energy inherently available in the cooling system to actuate the valve member.

The hydrostatic servo motor according to the invention should preferably be embodied as an internal gear motor, since an internal gear motor forms a hydrostatic servo motor of very compact construction, which is capable of delivering the drive energy for the valve member, which is preferably embodied as a rotary spool, so as advantageously to make direct use of the rotational driving motion of the internal gear motor as switching motion. Should it prove necessary, owing to particular design boundary conditions, to boost the torque delivered by a hydrostatic servo motor for use as switching motion, it is proposed to interpose a reduction gear, which may be embodied as a spur gear train, for example, between the hydrostatic servo motor and the valve member, preferably embodied as a rotary spool. This variant also allows existing electric motor drive units to be replaced by hydrostatic servo motors of the type forming the subject matter of the invention, in order to increase the robustness of such a heat management module.

An especially compact hydrostatic servomotor, which is embodied as an internal gear motor, is obtained in that an internally toothed internal gear of the internal gear motor forms the rotationally moving part of the hydrostatic servo motor and is integrally formed with the rotary spool of the valve member. In this case this functionally integrated component may be produced, for example, as an injection molded plastic or light metal part.

In conjunction with this it is proposed that the rotationally moving internally toothed internal gear should mesh with a sun gear, fixed and arranged eccentrically in relation to the former, in order to translate the principle of a gear motor. In order to ensure the driving motion through pressurization, the rotationally moving internally toothed internal gear should include a curved filler piece fixed and arranged eccentrically in relation to the former. By virtue of its externally curved shape, the filler piece seals the pressure area off from the internal toothing of the internal gear. An internally curved shape of the filler piece provides sealing in relation to the sun gear bearing against it.

According to a further measure designed to enhance the invention the internal gear motor, preferably constructed in the manner described above, is pressurized in that a first pressure connection is arranged on the end face of the drive area and a second pressure connection is arranged adjacent thereto, said connections being capable of two-way coupling to the feed pressure line, in order to be able to move the pressure-controlled valve member in both mutually opposed switching directions.

For such a two-way coupling of the two pressure connections to the feed pressure line, it is proposed to use a solenoid pilot valve as part of a hydraulic pilot control, which is preferably embodied as a monostable 4/3-way directional control valve. The three switch positions serve to implement the two mutually opposed switching motions and an additional closed position. In order to bring the monostable 4/3-way directional control valve into a defined emergency position, should the electrical control fail, it is proposed that this be of spring-returned design. Using the solenoid pilot valve, the solution according to the invention retains the advantages of electrically actuated systems in respect of the incorporation into the working of electronic controllers, so that a facility for incorporation of the heat management module according to the invention into the control algorithm of the engine control unit of an internal combustion engine is assured.

The feed pressure line according to the invention for actuation of the hydrostatic servo motor described above preferably emerges from the area of the discharge-side connection of a coolant pump integrated in the cooling system, since here the coolant pressure in the overall system is still not subject to any fall in pressure and is thereby at a maximum, so that the hydrostatic servo motor can be designed on the basis of the maximum coolant pressure prevailing there. This allows the hydrostatic servo motor to be designed with the smallest possible overall dimensions, to the benefit of the compactness of the heat management module.

BRIEF DESCRIPTION OF THE DRAWINGS

Further measures serving to enhance the invention will be represented in more detail below together with the description of a preferred exemplary embodiment of the invention referring to the figures, of which.

DETAILED DESCRIPTION OF THE DRAWINGS

Figure 1:
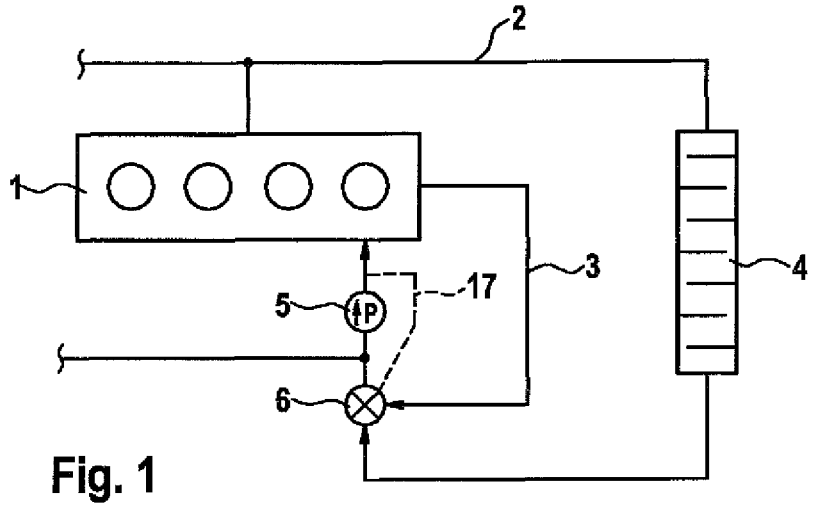
FIG. 1 shows a schematic representation of a cooling system of an internal combustion engine with integral heat management module.

According to FIG. 1, the cooling system of an internal combustion engine 1 substantially comprises a radiator circuit 2 and a bypass circuit 3. The radiator circuit 2 carries the coolant heated by the internal combustion engine 1 through a radiator 4 functioning as heat exchanger so that after cooling, the coolant, via a downstream coolant pump 5, is again available in the internal combustion engine 1 for cooling the latter. While this radiator circuit 2 is used for cooling the internal combustion engine 1, the bypass circuit 3 is used for heating up the internal combustion engine 1, particularly during the warm-up phase, in order to heat the coolant up as rapidly as possible to approximately the optimum temperature by bypassing the radiator 4. The choice between radiator circuit 2 and bypass circuit 3 or also a mixed operation between both circuits, essential for temperature control of the internal combustion engine 1, is made by a heat management module 6.

Figure 2:
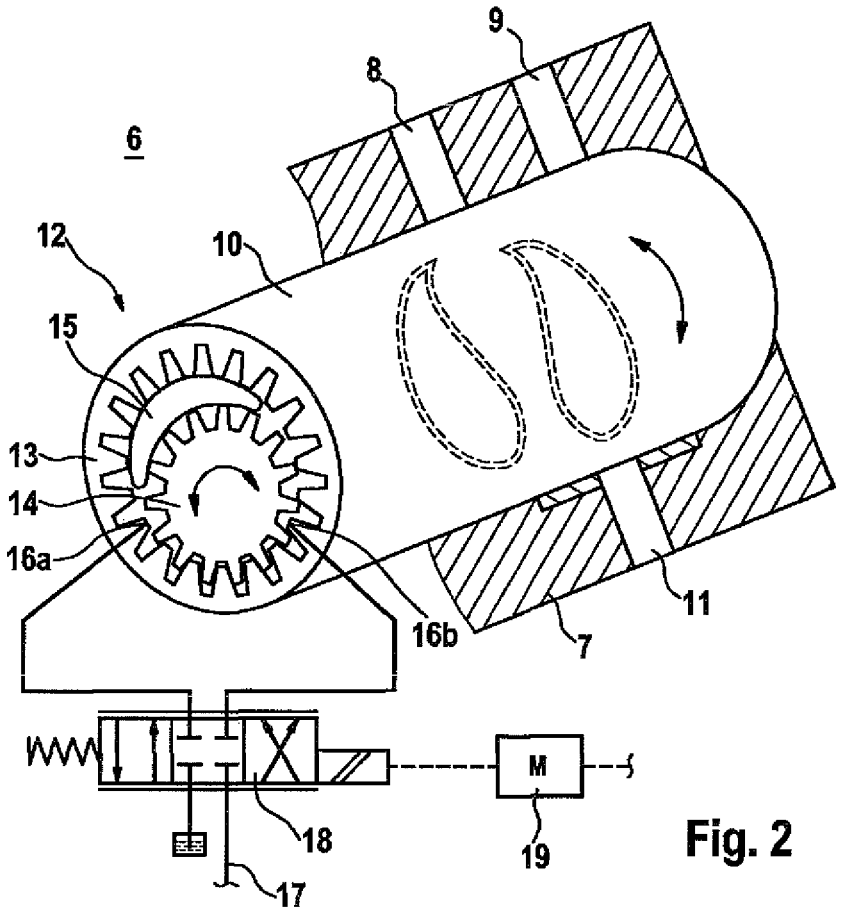
FIG. 2 shows a schematic perspective representation of the heat management module according to FIG. 1.

According to FIG. 2, the heat management module 6 comprises a valve housing 7 (here represented only in schematic section), on which are arranged a first feed connection 8 for the coolant of the bypass circuit 3 (not shown here) and at least one adjacent second feed connection 9 for the coolant of the radiator circuit 2 (likewise not represented here). Depending on the position of the valve member, here embodied as a rotary spool 10 and arranged in the valve housing 7, the two feed connections 8 and 9 can be selectively connected to a discharge connection 11, also arranged on the valve housing 7.

A hydrostatic servo motor 12, which directly actuates the rotary spool 10 producing a rotational driving motion, is provided as drive means for actuating the rotary spool 10. The hydrostatic servo motor 12 is embodied as an internal gear motor and comprises an internally toothed internal gear 13, which is designed for rotational motion integrally with the rotary spool 10. The internally toothed internal gear 13 meshes with a sun gear 14, arranged eccentrically in relation to the former, to form a gear motor. A curved filler piece 15, fixed and arranged eccentrically in relation to the internal gear 13, is also located therein. The filler piece 15 together with the sun gear 14, situated opposite and not coming to bear thereon, forms two opposing pressure chambers inside the gear motor, which are assigned to a first pressure connection 16*a* and a second pressure connection 16*b* arranged adjacently thereto.

The two pressure connections 16*a* and 16*b* can be two-way coupled to a feed pressure line 17, which taps the feed pressure directly from the cooling system of the internal combustion engine. For two-way coupling of the two pressure connections 16*a* and 16*b* of the hydrostatic servo motor 12 to the feed pressure line 17, a monostable 4/3-way directional control valve 18 is provided, which here functions as an electro-pneumatic pilot valve. The 4/3-way directional control valve 18 is electrically controlled by an electronic heat management control 19, which here is an integral part of the engine control.

The invention is not limited to the exemplary embodiment described above, but also encompasses modifications thereof, which are included in the scope of the claims below. Thus, instead of the embodiment of the valve member as rotary spool, a rotary disk or the like may also be used in order to form the valve mechanism of the heat management module 6. In addition it is also possible to opt for a translationally adjustable valve spool or the like as valve member. In this case, however, the rotational driving motion of the hydrostatic servo motor has to be translated by some mechanism into a translational driving motion which in this respect is essential for such a valve member. It is likewise feasible to couple the hydrostatic servo motor producing the driving motion to the valve member via an intermediate transmission mechanism in order to actuate said member, for which purpose a spur gear train, a worm gear or the like, for example, would be suitable, in order preferably to create a reduction gear for converting a high speed of the hydrostatic servo motor into a lower speed for producing the switching motion of the valve member.

LIST OF REFERENCE NUMERALS

1 Internal combustion engine
2 Radiator circuit
3 Bypass circuit
4 Radiator
5 Coolant pump
6 Heat management module
7 Valve housing
8 First feed connection
9 Second feed connection
10 Rotary spool
11 Discharge connection
12 Hydrostatic servomotor
13 Internal gear
14 Sun gear
15 Filler piece
16*a* First Pressure Connection
16*b* Second Pressure Connection
17 Feed pressure line
18 4/3-way directional control valve
19 Heat management control

The invention claimed is:

1. A heat management module of a cooling system, which includes a radiator circuit and a bypass circuit, of an internal combustion engine, comprising:

a valve housing having at least one first feed connection for coolant carried by the bypass circuit, at least one adjacent second feed connection for coolant carried by the radiator circuit, and a discharge connection;

a valve member arranged in the valve housing, the first feed connection and the second feed connection being connectable to the discharge connection depending on a position of the valve member; and a driving element, which actuates the valve member, being arranged on the valve housing, the driving element being a hydrostatic servo motor, which produces a rotational driving motion and has a feed pressure line for pressurization that branches off from the cooling system, wherein the hydrostatic servo motor comprises an internally toothed internal gear, a sun gear arranged eccentrically internal gear and in meshed engagement with the internal gear, and a curved filler piece arranged eccentrically in the internal gear and forming with the sun gear two opposing pressure chambers assigned to a first pressure connection and a second pressure connection, the first pressure connection and the second pressure connection being capable of two-way coupling to the feed pressure line.

2. The heat management module according to claim 1, and further comprising a control unit, wherein the valve member is a rotary spool, which is rotatably actuated by the drive element.

3. The heat management module according to claim 2, wherein the hydrostatic servo motor comprises an internally toothed internal gear and the internally toothed internal gear is a rotationally moving part which is integrally formed with the rotary spool.

4. The heat management module according to claim 1, further comprising a monostable 4/3-way directional control valve functioning as an electro-pneumatic valve that couples the first pressure connection and the second pressure connection to the feed pressure line.

5. The heat management module according to claim 4, wherein the monostable 4/3-way directional control valve is spring-returned to a defined emergency position.

6. The heat management module according to claim 3, wherein at least the valve housing, the internal rotary spool, the internally toothed internal gear and the sun gear are made of a plastic or a light metal casting.

7. A cooling system of an internal combustion engine, comprising:

a radiator circuit;

a bypass circuit;

a cooling pump for operating the radiator circuit and the bypass circuit being operated; and a heat management module for controlling the radiator circuit and the bypass circuit, the heat management module including a valve housing having at least one first feed connection for coolant carried by the bypass circuit, at least one adjacent second feed connection for coolant carried by the radiator circuit, and a discharge connection; a valve member arranged in the valve housing, the first feed connection and the second feed connection being connectable to the discharge connection depending on a position of the valve member; and a driving element, which actuates the valve member, being arranged on the valve housing, the driving element being a hydrostatic servo motor, which produces a rotational driving motion and has a feed pressure line for pressurization that branches off from the cooling system, wherein the hydrostatic servo motor comprises an internally toothed internal gear, a sun gear arranged eccentrically internal gear and in meshed engagement with the internal gear, and a curved filler piece arranged eccentrically in the internal gear and forming with the sun gear two opposing pressure chambers assigned to a first pressure connection and a second pressure connection, the first pressure connection and the second pressure connection being capable of two-way coupling to the feed pressure line.

8. The cooling system according to claim 7, wherein the feed pressure line is connected to the cooling system in an area of a discharge-side connection of the coolant pump.

* * * * *